US007491878B2

(12) United States Patent
Orr

(10) Patent No.: US 7,491,878 B2
(45) Date of Patent: Feb. 17, 2009

(54) METHOD AND APPARATUS FOR AUTOMATICALLY CREATING MUSICAL COMPOSITIONS

(75) Inventor: Brian Orr, Waterloo (CA)

(73) Assignees: Sony Corporation (JP); Sony Creative Software, Inc., Los Angeles, CA (US)

( * ) Notice: Subject to any disclaimer, the term of this patent is extended or adjusted under 35 U.S.C. 154(b) by 50 days.

(21) Appl. No.: 11/705,541

(22) Filed: Feb. 13, 2007

(65) Prior Publication Data

US 2007/0221044 A1 Sep. 27, 2007

Related U.S. Application Data

(60) Provisional application No. 60/781,603, filed on Mar. 10, 2006.

(51) Int. Cl.
*G10H 1/00* (2006.01)

(52) U.S. Cl. ..... 84/609; 84/634; 84/649

(58) Field of Classification Search ..... 84/600–602, 84/609, 634, 649, 650, 645
See application file for complete search history.

(56) References Cited

U.S. PATENT DOCUMENTS

| | | | |
|---|---|---|---|
| 5,375,501 | A | 12/1994 | Okuda |
| 5,496,962 | A | 3/1996 | Meier et al. |
| 5,693,902 | A | 12/1997 | Hufford et al. |
| 5,877,445 | A | 3/1999 | Hufford et al. |
| 6,756,534 | B2 | 6/2004 | Gimpelson et al. |
| 2006/0000344 | A1 | 1/2006 | Basu |

OTHER PUBLICATIONS

User's Manual Macintosh Version 4: "Band-in-a-Box", 1991, pp. 1-46, Canada.
Notification of Transmittal of the International Search Report and the Written Opinion of the International Searching Authority, or the Declaration, International Application No. PCT/US07/05967; International Filing Date: Mar. 8, 2007.
Adobe Systems Inc.: "Adobe Audition 2.0" http://digitalproducer.digitalmedianet.com/articles/viewarticle.jsp?id=36828.
RealNetworks Inc.: "Acoustica MP3 Audio Mixer" http://www.acoustica.com/mp3-audio-mixer/.
Digital Borneo: "DB Audio Mixer & Editor" http://www.audio-mixer-editor.net/.

*Primary Examiner*—David S. Warren
(74) *Attorney, Agent, or Firm*—Rader Fishman & Grauer PLLC; Ronald P. Kananen

(57) ABSTRACT

A music generation engine automatically generates musical compositions by accessing musical sections and corresponding properties including similarity factors that provide a quantified indication of the similarity of musical sections to one another (e.g., a percentage of similarity). A sequential relationship of the musical sections is then determined according to an algorithmic process that uses the similarity factors to assess the desirability of the sequential relationship. The algorithmically created musical composition may then be stored, such as by rendering the composition as an audio file or by storing a library file that refers to the musical sections. The created musical composition may include layers respectively having different audio elements such that the created musical composition has a first dimension along a timeline and a second dimension that provides a depth based upon the presence of different audio elements. The presence and absence of audio elements along the timeline can be based upon the value of an intensity parameter, which may be an intensity envelope that is predetermined or automatically generated based upon user specifications.

22 Claims, 8 Drawing Sheets

200b

200c

300

400

500

METHOD AND APPARATUS FOR AUTOMATICALLY CREATING MUSICAL COMPOSITIONS

CROSS REFERENCE TO RELATED APPLICATIONS

This application claims the benefit under 35 U.S.C. § 119 of previously filed provisional patent application Ser. No. 60/781,603, filed on Mar. 10, 2006 and entitled "Pseudo-random Music Generator," the entire contents of which are hereby incorporated by reference.

BACKGROUND OF THE INVENTION

1. Field of the Invention

This invention relates generally to music generation and more particularly to automatically creating musical compositions from musical sections.

2. Description of the Related Art

It has been long known to automatically create new musical compositions from existing elements, ranging from simplistic compilations that string together potentially ill-fitting pieces to complicated algorithms that mathematically create progressions, melodies, or rhythms at various levels of granularity.

Existing solutions have remaining inadequacies, particularly for users who are seeking to produce production quality music to be used in association with other media, such as a score for a video, a game, or the like. These solutions typically are either too simple or crude to be useful, or do not offer the user adequate input as to how the music should be composed, both generally, and with regard to how the music may vary within a composition. Additionally, these solutions are one-dimensional, typically taking musical elements and merely connecting them along a timeline. In that sense, there is both a lack of flexibility as to the potential variation within the composed music, as well as a lack of depth in the finished product.

What is needed is automatic music composition that accommodates the creation of musical compositions in any style of music, retains the quality of the original audio elements, provides an element of depth, and allows the user to easily control and configure how the music is to be composed.

SUMMARY OF THE INVENTION

According to one aspect, one or more embodiments of the present invention embodiment may automatically create musical compositions by accessing musical sections and corresponding properties including similarity factors that provide a quantified indication of the similarity of musical sections to one another (e.g., a percentage of similarity). A sequential relationship of the musical sections is then determined according to an algorithmic process that uses the similarity factors to assess the desirability of the sequential relationship. The algorithmically created musical composition may then be stored, such as by rendering the composition as an audio file or by storing a library file that refers to the musical sections.

The algorithmic process may also apply a variance factor whose value is used to determine how similar respective musical sections should be in sequencing the plurality of musical sections, as well as a randomness factor whose value is used to determine how random respective musical sections should be in sequencing the plurality of musical sections.

According to another aspect, the created musical composition includes layers, with respective layers providing different audio elements (which may be referred to as tracks) corresponding to the musical sections, such that the created musical composition is multidimensional, with a first dimension corresponding to a timeline of the created musical composition, and a second dimension corresponding to a depth of the created musical composition according to the presence of one or more of the different audio elements within respective musical sections in the created musical composition.

The presence and absence of tracks within respective musical sections in the created musical composition along the timeline can be based upon the value of an intensity parameter, which may be an intensity envelope that is predetermined or automatically generated based upon user specifications.

The present invention can be embodied in various forms, including business processes, computer implemented methods, computer program products, computer systems and networks, user interfaces, application programming interfaces, and the like.

BRIEF DESCRIPTION OF THE DRAWINGS

These and other more detailed and specific features of the present invention are more fully disclosed in the following specification, reference being had to the accompanying drawings, in which.

DETAILED DESCRIPTION OF THE INVENTION

In the following description, for purposes of explanation, numerous details are set forth, such as flowcharts and system configurations, in order to provide an understanding of one or more embodiments of the present invention. However, it is and will be apparent to one skilled in the art that these specific details are not required in order to practice the present invention.

Figure 1:
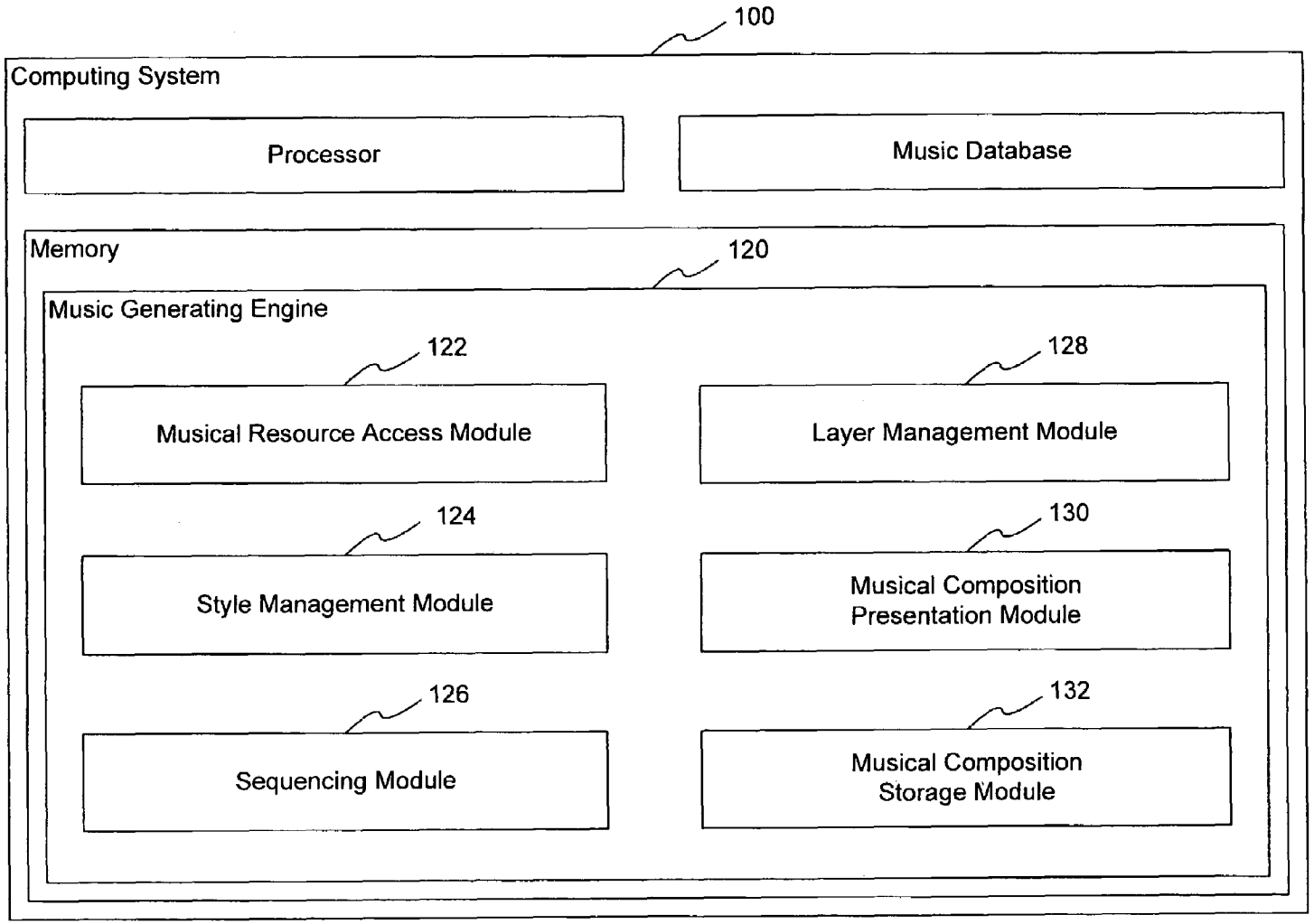
FIG. 1 is a block diagram illustrating an example of a music generation system including a music generation engine according to one embodiment of the present invention.

FIG. 1 is a block diagram illustrating a music generating system 100 according to an embodiment of the present invention. The music generating system 100 comprises a computer system having a processor and memory with a music generation engine 120 resident therein. The computer system, including the corresponding processor, memory, operating system and related input and output devices may be any conventional system. The music generation engine 120 is preferably a software based music generation engine that creates pseudo-random music compositions from pre-composed pieces of audio. The music that is created can be of any desired user length, is re-creatable (using the same input parameters), and can be directly altered through settings directly controlled by the user.

The music generation engine 120 creates compositions of music by combining musical elements across two dimensions: 1) time and 2) layering. It has been long known that by following certain rules, musical sections can be re-ordered in time to create alternate versions of a musical composition. In accordance with this aspect, the music generation engine 120 adds another dimension (layering), by allowing different audio elements to be added or removed throughout the piece. These audio elements allow the user/composer to create a musical composition with different instrumentation, sounds, or motifs for respective sections (even if they are repeated). By applying intuitive and easy to follow input parameters, users are able to create a multitude of different variations of a given composition using the music generation engine 120.

The music generation engine 120 operates to create musical compositions in various applications. One useful application is scoring high-quality music soundtracks for video projects. The music generation engine 120 accommodates the typical need by videographers for royalty-free music that can adapt to any length of time, and is unique to their video project.

The music generation engine 120 also operates to create musical compositions that are then stored for future usage. Additionally, the music generation engine 120 can operate in real time, which may be useful for systems that, among other things, require interactive music. Possible applications include video game music (where the music changes according to the player's status in the game), background music for interactive websites and menu systems (responding to choices the user makes), on-hold music for telephony, and creating alternate "remixes" of music for audio and video devices.

Preferably, the music generation engine does not attempt to mathematically create chord progressions, melodies, or rhythms. These techniques produce results that are usually tied to a specific genre or style, and often fail to produce results suitable enough for production-quality music. Rather, the music generation engine 120 preferably uses pre-composed audio elements, which accommodates the creation of musical compositions in any style of music and retains the quality of the original audio elements.

In addition to sequencing musical sections, the music generation engine 120 provides layered compositions that are also user-configurable. By layering different audio elements over time, music can sound radically different even if the same musical section is repeated many times. This opens up the possibility of nearly infinite combinations of music for a given style, which means that a given style won't necessarily sound the same in two separate applications.

The music generation engine 120 also preferably works from a music database. The database may be stored on the hard disk of the computing system, or may be an external drive, including but not limited to one that is accessed through a network (LAN, Internet, etc.). The music database may contain prepackaged content that may comprise works that are already divided into musical sections. Although a variety of resources may be implemented for sourcing music and corresponding musical sections, in one example the music generation engine 120 may use musical sections that are defined using Sony Media Software's ACID technology.

The music generation engine 120 accommodates changes to the generated music that are not possible in other simpler music generation technologies. For instance, modifying tempo, key, audio effects, MIDI, soft-synths, and envelopes are all possible throughout the course of a generated composition.

The music generation engine 120 also allows additional user 'hints', allowing the user to specify any additional desired changes (such as tempo or instrumentation) at given points in their generated music. These features are useful for allowing still another level of control over the final generated composition. The music generation engine 120 may use a variety of specific media technology and combinations thereof, including MIDI, waveform audio (in multiple formats), soft-synths, audio effects, etc. Finally, the music generation engine 120 can generate and preview the music in real-time, preferably rendering the created musical composition once the user is ready to save the music as an audio file.

Before turning to further description of the functionality of the music generation engine 120, it is noted that FIG. 1 illustrates one embodiment of the music generation engine 120 and corresponding modules. The described functionality may be provided by fewer, greater, or differently named modules. Also, the illustrated system is merely an example of an operational environment, such as may be encountered where a user implements a desktop computer, laptop, personal computing device, or the like. The music generation engine 120 may also be provided and accessed in a network environment. For example, the music generation engine 120 functionality may be accessed through a computer network by a user invoking a browser. The functionality may also be distributed among various devices.

Although the music generation engine 120 is preferably provided as software, it may also comprise hardware and/or firmware elements. The music generation engine 120 comprises a musical resource access module 122, a style module 124, a sequencing module 126, a layer management module 128, a musical composition presentation module 130, and a musical composition storage module 132. The music generation engine 120 also operates in conjunction with a music database as described.

The musical resource access module 122 and the style module 124 respectively access the database that stores the musical elements (e.g., sections) used as the basis for creating a musical composition, and maintain properties corresponding to the musical sections. As will be described more fully below, these properties include a variety of information about each musical section, including similarity factors that provide a quantified indication (e.g., from 0-100%) of the similarity of individual musical sections to other musical sections. It is noted that in some embodiments, the maintenance of the section properties may, at least in part, be provided through the music database. That is, a prepackaged music database may contain previously prepared sections having properties. The music generation engine 120 may also be configured to allow the user to embellish and manage such properties, where applicable.

The sequencing module 126 sequences the musical sections to create a musical composition. The respective musical sections with a created musical composition are sequenced based upon the properties that are respectively associated with them. According to one aspect of the music generation engine 120, the sequential relationship of respective ones of the musical sections is determined according to an algorithmic process that uses the similarity factors to assess the desirability of the sequencing particular musical sections. Additionally, user-configurable parameters of variance and randomness dictate how such similarity factors are applied in determining the sequence of musical sections, as described in further detail below.

The layer management module 128 and the musical composition presentation module 130 respectively provide for the management of the layers within a musical composition, and the user interface that graphically displays a visual representation of the musical composition, both as to the musical sections in the direction of the timeline (preferably presented in the "x" direction) and the direction corresponding to the "depth" of the musical composition due to the presence or absence of particular layers (preferably presented in the "y" direction). The layers comprise audio elements, which may also be referred to as tracks, and which may be named according to the instrument(s) represented therein, such as "piano", "guitar", "drums", "bass" and others.

Finally, the musical composition storage module 132 retains information corresponding to the musical composition as it is created (i.e., identification of the musical sections contained therein, as well as the sequencing thereof). This information is updated if and when the user edits the musical composition following its initial creation. Once the user is satisfied with the created musical composition, a save feature allows the work to be saved, and the musical composition storage module 132 functions accordingly. The save may include options to save the created composition (1) as rendered audio (e.g., as a WAV file), or (2) as a project file (e.g., as an XML file outlining the generation settings (i.e., referring to the musical sections of the created musical composition rather than storing the musical sections per se)).

The various features of the music generation engine 120 and corresponding modules are further described with reference to display diagrams that illustrate the functionality of the engine as well as the corresponding user interface.

Figure 2A:
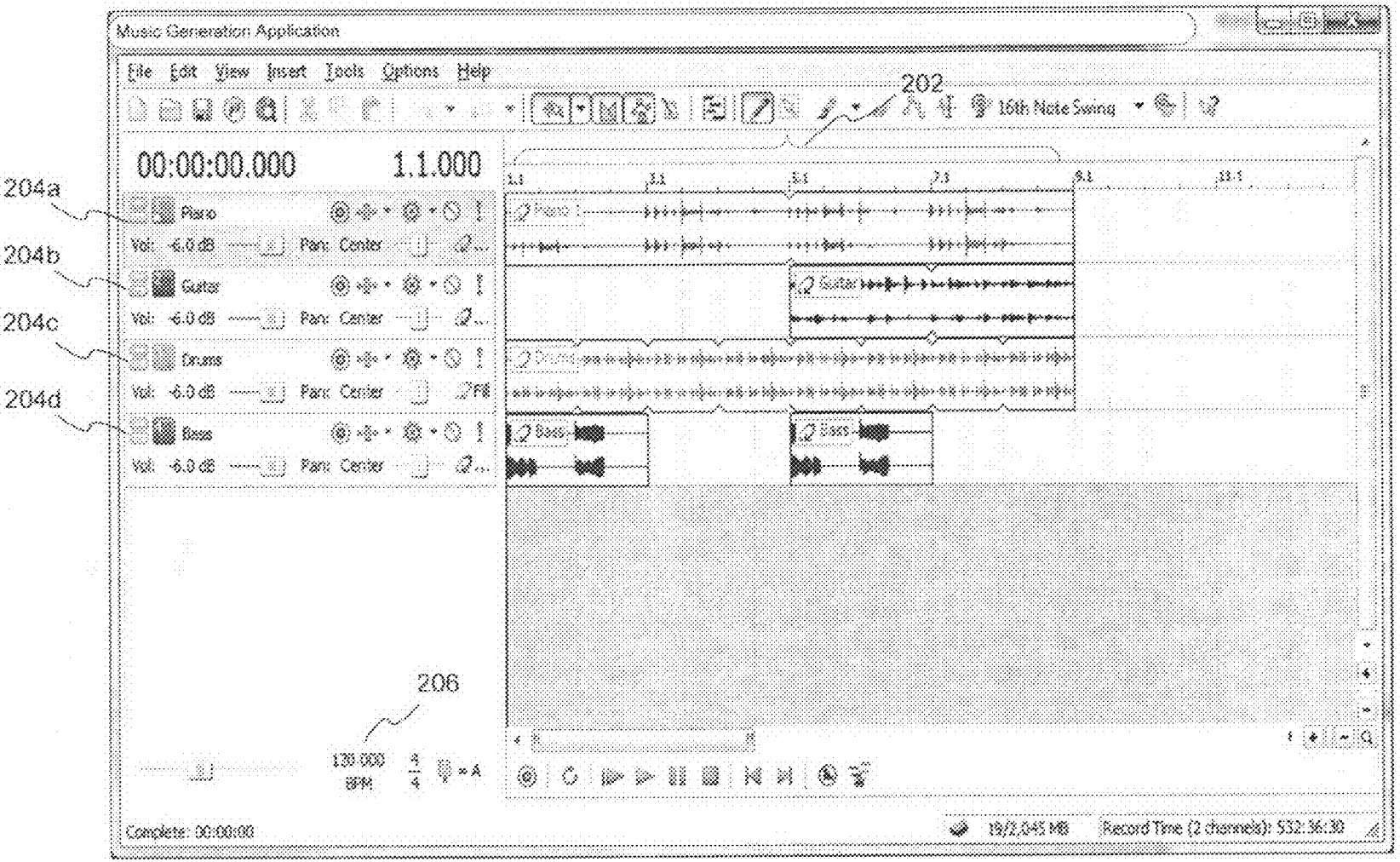
FIG. 2A is a display diagram illustrating an interface for displaying and editing components of a musical composition.

With the music generation engine 120, a "style" refers to not only the musical sections, but also the corresponding properties that are associated therewith. These properties allow application of the rules for generating a musical composition. As described above, the musical composition is created and rendered in two dimensions: the x-dimension is a timeline with musical data (events, envelopes, and grooves). The y-dimension is the tracks themselves, which usually provide different instruments or sounds. FIG. 2A is a display diagram 200*a* illustrating these features. Here, the timeline 202 is labeled in terms of bars (each tick indicates a bar, with bars 1, 5, 9, etc. noted). The depth of the composition is conveyed graphically through the presence of absence of audio elements (tracks) 204*a-d,* which may also be referred to as tracks. Preferably, the tracks have distinguishing graphical characteristics (from each other) so that the user easily sees where the tracks are active and inactive. Additionally, each track has volume and other controls that allow characteristics for individual tracks to be manipulated by the user. Additional information, such as the music time and the tempo 206 (e.g., 120.000 beats per minute) is also provided.

In this example, there are four tracks—piano, guitar, drums and bass. At the start of the composition, only the piano, drums and bass are active. At bar 3, the bass drops out, only to re-enter with the guitar at bar 5. The music generation engine 120 allows the user to add or remove the desired instruments from the musical composition using conventional cursor operations. When these actions are performed, the representation of the musical composition in the musical composition storage module 132 updates. The music generation engine 120 creates different variations of a section by changing the layering of the tracks at a given time. The styles allow composer-defined rules that in turn allow the music generation engine 120 to turn on or off tracks across a given composition. This opens up many possibilities for how the final composition will sound.

The above example illustrates how a composer would create (and manipulate) styles that ultimately affect the musical compositions that are created by the music generation engine. In a more complex example, there may be dozens of tracks, each with different instrumentation, effects, volume and panning, and so forth.

In some embodiments, the music generation engine 120 may be equipped to support the composer role, and in others functionality may be restricted such that only music generation from previously created styles is provided. That is, in the former case the music generation engine 120 is equipped to graphically accommodate selection of instruments as the tracks and over time add or remove instruments to create and edit styles as described above. In another embodiment, the music generation engine 120 (from the perspective of the user) generates musical compositions from previously established styles, without requiring or necessarily even allowing the user to edit and manipulate the styles.

Figure 2B:
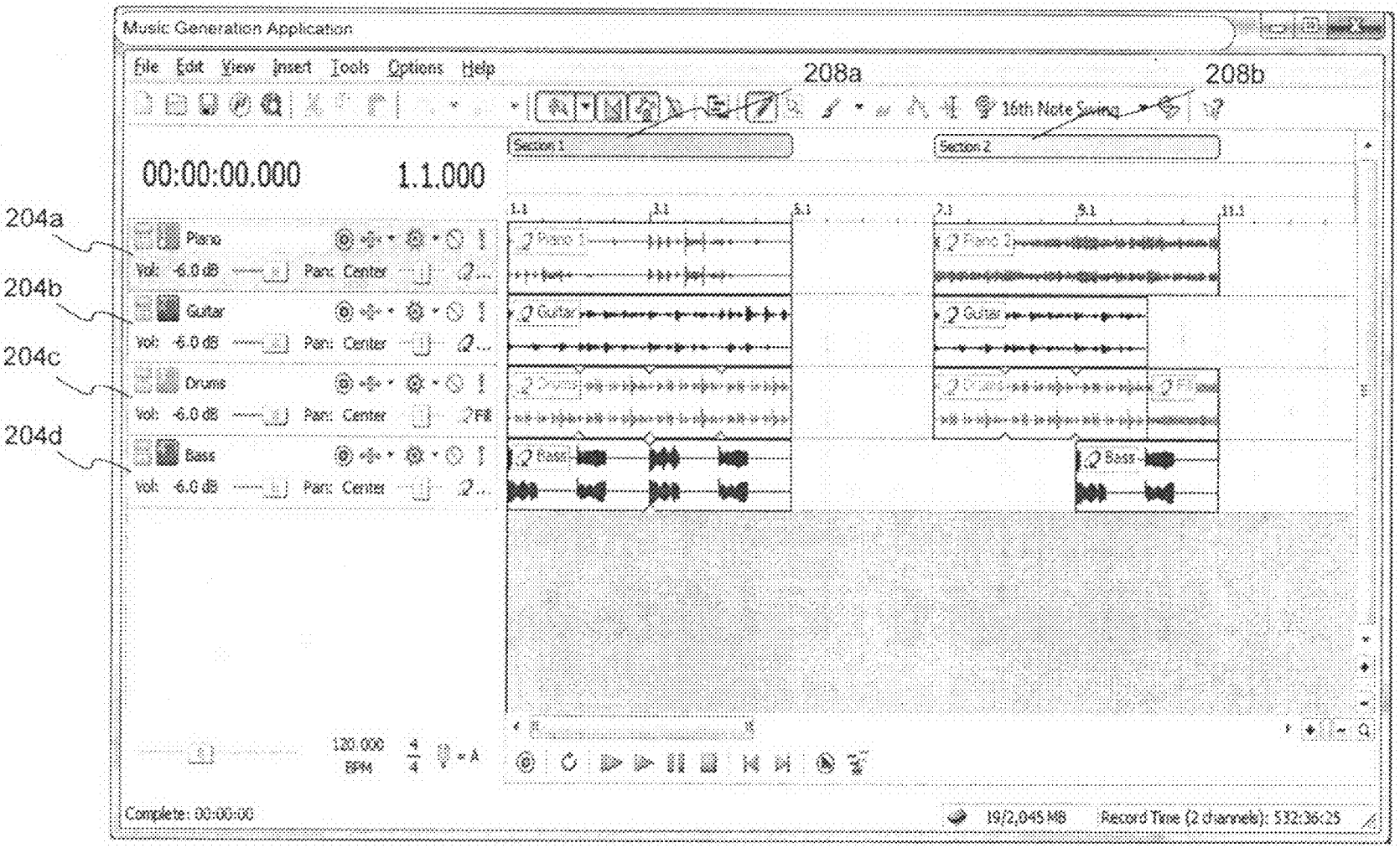
FIG. 2B is a display diagram illustrating an interface that displays musical sections along a timeline.

FIG. 2B is a display diagram 200*b* illustrating musical sections along a timeline (i.e., in the "x" dimension). The sections are time ranges that are used to determine the possible thematic arrangements in the generated composition. This example illustrates a composition with 2 sections (Section 1 (208*a*) and Section 2 (208*b*)). These could be labeled "Verse" and "Chorus" to use musical terminology. The music generation engine 120 defines rules for what happens when a given section is complete. For instance, at the end of Section 1, the composer may decide that Section 1 can repeat itself, or continue on to Section 2. Likewise, after Section 2, the composer may decide that Section 2 can go back to Section 1, go onto Section 3 (not shown), or go to one or more possible endings (not shown). These time ordering rules allow the music generation engine 120 engine to create a composition that closely fits the user's desired time for the generated music.

These time ordering rules allow the music generation engine 120 to create a composition that closely fits the user's desired time for the generated music. As an example, if each section is 8 seconds long, and the user asks for 30 seconds of music, the output may be: Section 1—Section 2—Section 1—Section 2.

As noted, the music generation engine 120 stores properties related to sections. These properties include the length of the section. The length of the section may be defined in terms of the variable beats, rather than time (e.g., seconds), or may alternatively be defined as a duration in time. Accordingly, the stored record of properties for a particular section includes the number of beats corresponding to the section. To explain with reference to FIG. 2B, the labels "1.1" and "9.1" respectively refer to bar 1, beat 1 and bar 9, beat 1 along the x-axis. On the lower portion of the display, there is indication that the music is 4/4, which means that there are 4 beats per bar. Accordingly, section 1 has 4 bars, and is a 16 beat section.

Although the stored properties for a section include beats, there may be a subsequent conversion to units of time. This conversion may in turn be based upon a tempo setting. That is, if section 1 is 16 beats and the tempo setting is 120 beats per minute, a resultant calculation may determine that the section has a corresponding length in time.

Continuing with the above example, these calculations may create a piece of music that is 32 seconds long, which is the closest fit to the desired 30 seconds of music. At this point, the user may be happy with 32 seconds of music, may decide to fade out the extra music, or may change the tempo to fit the composition exactly to 30 seconds.

Preferably, the music generation engine 120 first generates music by picking sections that are appropriate, for sequencing according to their properties (e.g., similarity factor) and user settings (e.g., variance and randomness), and according to the requested length of the composition, as described further regarding the algorithmic process below.

Once the song arrangement has been chosen, tracks are added and removed at each section to create a dynamically changing layered composition with multiple sections. A typical music generation engine 120 style may have many sections, each with their set of rules of what can happen when that section is complete. However, even in the example above, two unique sections with varying instrumentation accommodates many variations of compositions. For instance, the generated music may have Section 1 repeated 4 times, but each time a new instrument is added. Then Section 2 may be chosen, and instruments may be further added or removed.

In one embodiment, the music generation engine creates a composition by first generating the sequence information (section order) followed by the layering information. The layering is done by assigning a mood, arrangement and intensity setting to each section. So the resultant composition, in memory, has information as follows:

a) Section 1 (Mood=A, Arr.=1, Intensity=10%)

b) Section 2 (Mood=A, Arr.=1, Intensity=50%)

c) Section 3 (Mood=B, Arr.=1, Intensity=80%)

When the music is actually generated (for playback or rendering), the sections may be written out as a new project file, with the mood, arrangement and intensity for each section being used to determine the actual layers (tracks) used for that section.

Figure 2C:
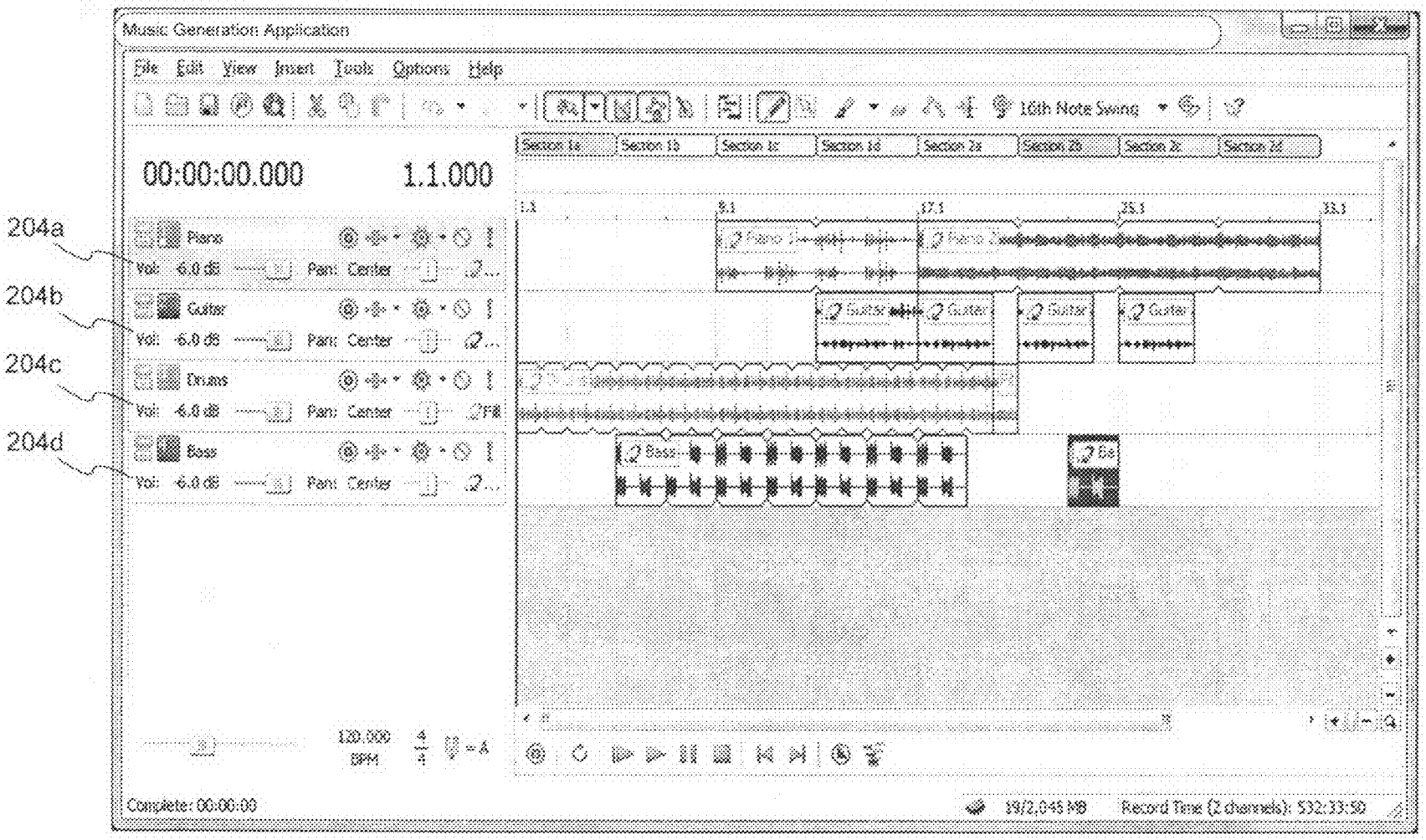
FIG. 2C is a display diagram illustrating an interface that includes a customized musical composition after generation and layering operations.

FIG. 2C is a display diagram 200*c* illustrating a customized musical composition after initial generation and layering operations. In this example, the generated music starts with drums, introduces bass, then piano and guitar. At bar 17, all instruments switch to Section 2, and are removed over time until just piano is playing. This example illustrates 32 bars of unique music that varies from a simple example of only two 4-bar sections.

The music generation engine 120 style contains additional information (or "rules") beyond the musical events, sounds, and effects of the musical section(s). These rules outline the usage of sections and track layering for the music generation engine 120 engine. Sections are regions of time that are defined in the music generation engine 120 style. Sections allow the music generation engine 120 engine to choose the appropriate song arrangement to fit the requested length of time for the composition.

A section has properties associated with it, such as: start section—indicates that this section can be used to start the composition; end section—indicates that this section be used to end the composition; fade out—indicates that this section can be used to fade out at the end of a composition. Furthermore, each section has a list of destination sections that can be chosen once the current section is complete. Each destination has a similarity factor that is used by the music generation engine 120 engine to generate different variations of sections depending on user input parameters.

For instance, at the completion of Verse 1, the next musical section choices may be Verse 2, Chorus, or Bridge. Each of these destination sections are in a list associated with Verse 1, such as follows:

| Destination | Similarity |
|---|---|
| Verse 2 | 100 |
| Chorus | 50 |
| Bridge | 10 |

The music generation engine 120 preferably uses an algorithmic process to determine the order of sections. Particularly, the Music generation engine 120 may use the similarity factor in combination with two user parameters ("Variance" and "Randomness") to control what section is chosen next. The Variance factor affects how different neighboring sections should be, and Randomness affects how close to the suggested section (based on Variance) that is actually chosen.

Figure 3:
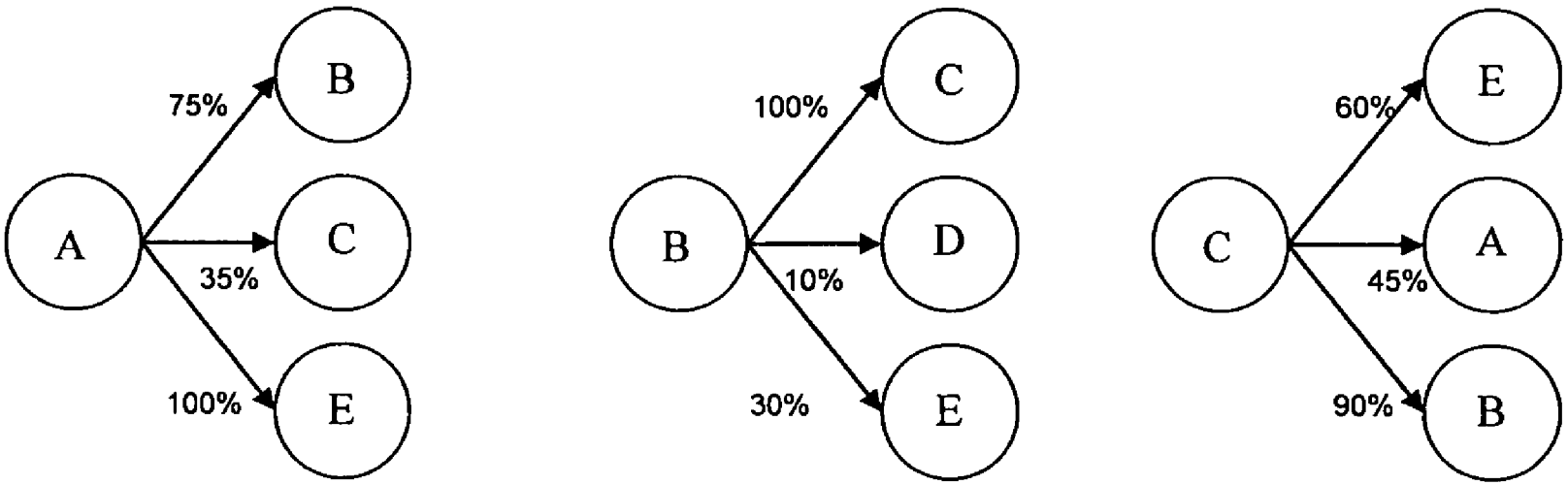
FIG. 3 is a schematic diagram illustrating an example of an algorithmic process implemented by the music generation engine.

The music generation engine 120 implements the algorithmic process by starting with a section and algorithmically choosing additional sections based upon first and second points of interest. According to the first point of interest, every destination has a similarity factor, and according to a second point of interest, the user provides the variance and Randomness settings that bias the similarity weight. Variance controls how "varied" the music will be. If the variance is low, sections will be chosen that are most similar to the current section. If the variance setting is high, sections will be chosen that are least similar to the current section. Randomness controls how "random" the music will be. This provides a degree to which the variance setting will be overridden. As the randomness setting goes higher, the adherence to the variance setting lowers. A very high randomness setting will cause selection of a section that essentially ignores the variance setting, making the selection of the section practically random. FIG. 3 is a graphical diagram 300 illustrating an example of an algorithmic process. Assume that there are five sections: A, B, C, D and E each having respective lengths and characteristics.

Assume that the user wants to generate 25 seconds of music, they start with A, and E is an ending. Also assume that Randomness is set low, and Variance is set low. This creates "similar" music from section to section with little or no randomization. The algorithmic process results in the following:

| Step | Section order | Notes |
|---|---|---|
| 1 | A | First section chosen |
| 2 | A-E | Algorithmically choose an option from A. E is the most similar, so use it. But this is too short, so remove and try another option |
| 3 | A-B | Choose the next most similar option |
| 4 | A-B-C | Choose the first most similar option to B |
| 5 | A-B-C-B | Choose the first most similar option to C |
| 6 | A-B-C-B-C | Choose the first most similar option to B. C is not an ending and list long enough, so remove C |
| 7 | A-B-C-B-E | Choose next most similar option to B, which is E - the ending. Done! |

This example illustrates the principle of the algorithmic process, which may of course be more complicated and involve much more sections. In contrast to iteratively checking each section for a good fit (i.e., for A, checking B, then C, then D, etc., in some order), the algorithmic process invokes the similarity factor, as well as the Variance and Randomness settings to determine a next section. Also, in the algorithmic process, changes to the variance and randomness settings could completely change the ordering of the resulting section list. For instance, if Variance is not at 0%, then sometimes a similar section will be selected and other times a less-similar section will be selected. So the order of the resulting sections can be altered and changed by the user's input settings.

In one embodiment, the algorithmic process operates as follows.

a) Variance controls how quickly the music changes, and thus a variance factor (per second) is determined.

b) An internal accumulator variable is maintained, which is added to every time a section is used for the composition.

c) The amount added to the accumulator is directly proportional to the length of the section picked. (e.g., assuming a variance factor of 0.1 per second, a 1 second segment may add 0.1 to the accumulator, and likewise a 2 second segment may add 0.2 to the accumulator.)

d) Next, this accumulator is used as biasing factor for all similarity factors for the next section to be picked. When the accumulator is low, sections with higher similarity are preferred. As the accumulator rises, sections with differing similarities are preferred.

e) When a section is chosen, the accumulator is reduced proportionally by the amount of the destination section's similarity. A 100% similar section doesn't reduce the accumulator at all, whereas a 0% similar section reduces it to 0.

f) Finally, the randomness factor determines how much the algorithm is overridden and thus randomized.

In addition to the above example (involving Verse 1, Verse 2), a composer could define sections of time to have finer granularity. For instance, Verse 1 might be defined as Verse 1*a*, Verse 1*b*, Verse 1*c* and Verse 1*d* (each having destinations to the following section, or to possible endings). This enables the music generation engine 120 engine to create compositions that more closely match the requested length of music.

For instance, for a musical composition including Verse 1, Verse 2 and Ending (each being 8 seconds long), and a desired length of 28 seconds, music generation engine 120 may try to create two compositions to fit:

(1) Verse 1—Verse 2—Verse 1—Ending (32 seconds), or (2) Verse 1—Verse 2—Ending (24 seconds).

The first composition is 4 seconds too long and the second is 4 seconds too short. The music generation accommodates partial versus, provided that the style defines them as such. Music generation engine 120 may thus accommodate a more closely fitting composition:

Verse 1*a*—Verse 1*b*—Verse 1*c*—Verse 1*d*—Verse 2—Verse 1*a*—Verse 1*b*—Ending.

Each sub-section for Verse 1 is 2-seconds long, and thus the resulting composition is exactly 28 seconds long. Of course, these divisions are decisions made by the composer, so subsections can be created at appropriate musical moments.

Figure 4:
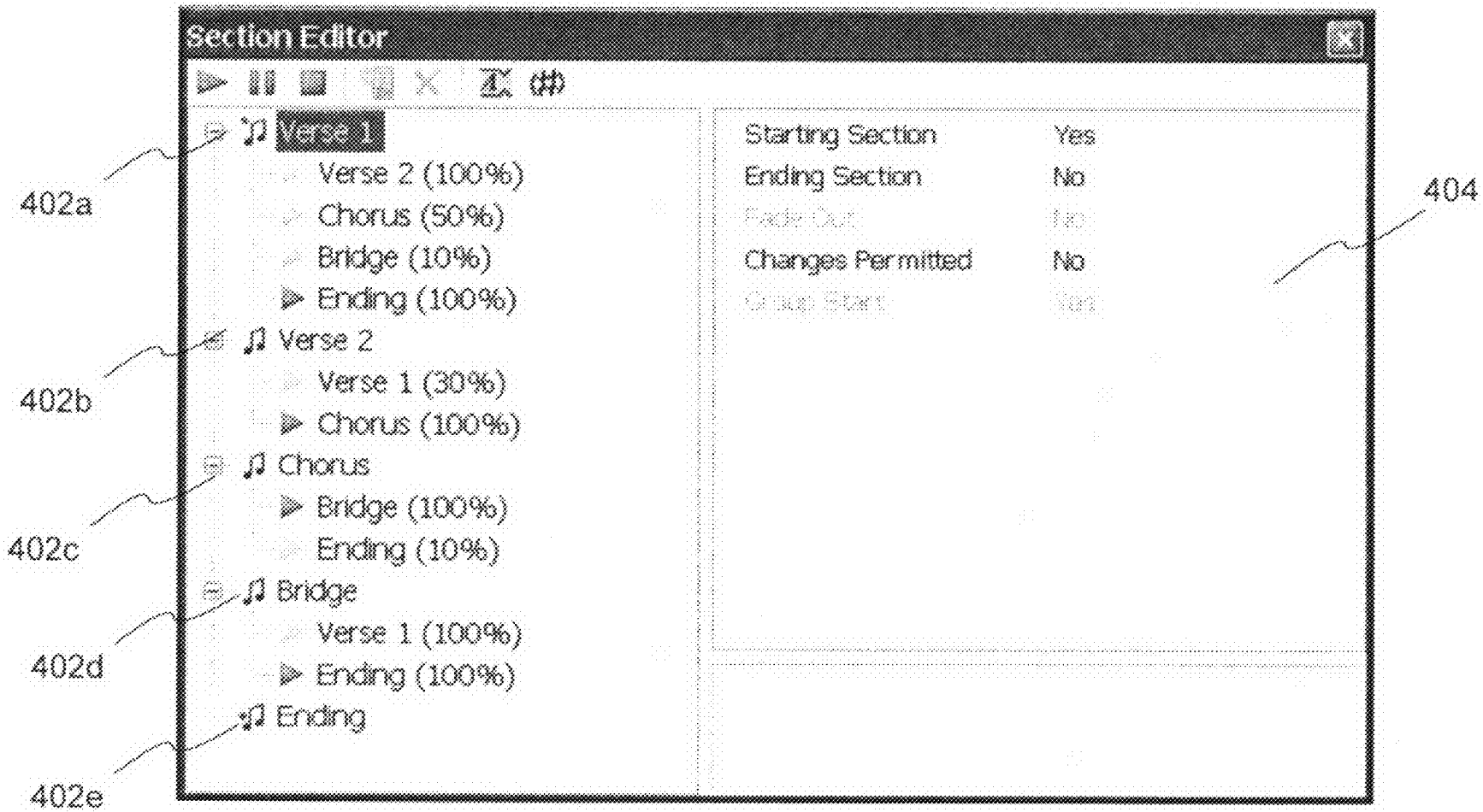
FIG. 4 is a display diagram illustrating an example of an interface for editing musical section information in support of automatic generation of a musical composition by the music generation engine.

FIG. 4 is a display diagram 400 illustrating an example of an interface used by the composer to configure sections for a style using the music generation engine 120. A left panel is navigational, with entries for the various sections 402*a-e* being configured. The sections can be named by the composer so that the composer is able to visually manage their potential implementation in created compositions. Additionally, the similarity factors vis-a-vis other sections are illustrated and may be similarly configured by the composer using conventional operations. When a current section is selected in the panel, an informational panel 404 updates to provide additional information about the current section. This information may also be edited by the user/composer, such as indicating whether a section is appropriate as a beginning, ending, etc.

The example of FIG. 4 indicates that Verse 1 has destinations Verse 2, Chorus, Bridge and Ending (all with respective similarity factors indicated). On the right are additional settings for the selected section.

Figure 5:
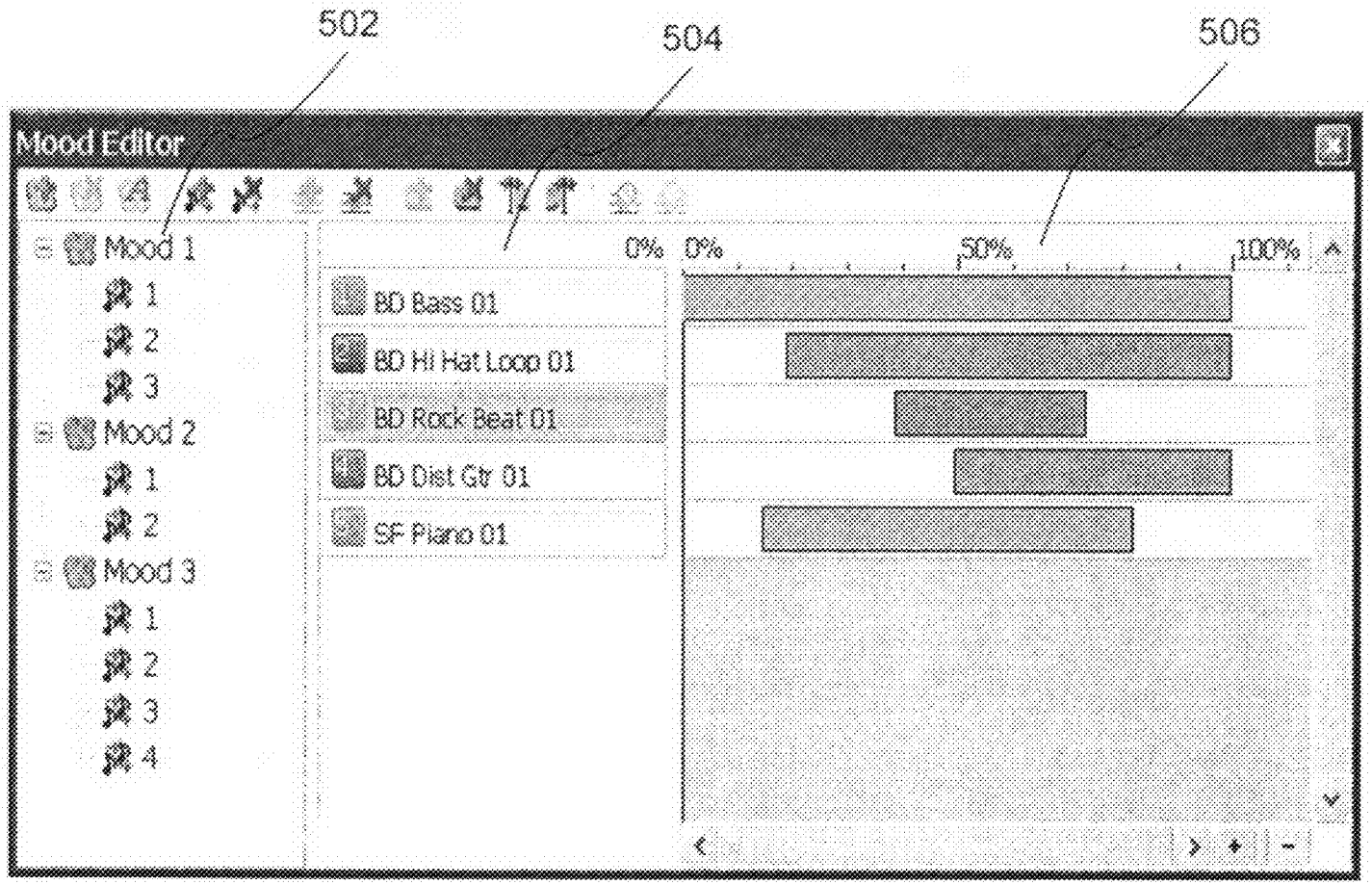
FIG. 5 is a display diagram illustrating an example of an interface for editing mood, intensity and arrangement parameters with the music generation engine.

The layering of tracks within a style may also be affected by the parameters mood, arrangement and intensity. FIG. 5 is a display diagram 500 illustrating an example of an interface through which the user configures such parameters. The leftmost portion of the interface includes a navigational section 502 for navigating to and naming the various moods and the arrangements of these moods, the middle portion includes a section 504 for identifying the tracks corresponding to the currently selected mood, and a rightmost portion of the interface includes a set of intensity triggers 506, indicating for which intensities the corresponding tracks should be used.

Mood determines a set of tracks to use for the composition. For instance, one mood may use instruments piano, acoustic guitar, bass, and bongos; whereas a second mood may use synthesizer, electric guitar, bass and full drum kit. Of course, moods can be much more interesting: for instance, one mood may provide the same instrumentation but using different motifs or melodies, different harmonies, or different feels or grooves. A good example would be a mood for a composition in a major key vs. a mood in a minor key.

Intensity controls how many of the instruments in the mood are currently active. For instance, at intensity=0%, only the piano might be active. As intensity is increased, the acoustic guitar is introduced, followed by bass—and finally bongos at 100% intensity.

Music generation engine 120 also defines when an instrument can turn off—for instance, the piano might only be active from 40%-70% intensity. This also allows for even more interesting possibilities. For example, it may not always be desired to completely remove an instrument, but rather just change something about the instrument as intensity changes. A simple bass track with whole notes only might be active from 0%-33% intensity; from 33%-66% a more involved one with quarter notes and some basic fills is triggered; finally, from 66%-100% a very active bass line is used, completed with fills and rapid notes.

Finally, arrangement allows for multiple variations of the same set of tracks in a given mood. For instance, a mood may define instruments piano, acoustic guitar, bass and bongos. A typical set of intensities for this may be: Piano=0%, guitar=25%, bass=50%, bongos=100%.

With arrangements, multiple variations of intensities can be set up. For example:

| Arrangement 1 | | Arrangement 2 | | Arrangement 3 | | Arrangement 4 | |
|---|---|---|---|---|---|---|---|
| Piano | 0% | Guitar | 0% | Bass | 0% | Bongos | 0% |
| Guitar | 25% | Bongos | 30% | Bongos | 20% | Bass | 25% |
| Bass | 50% | Piano | 60% | Piano | 50% | Guitar | 50% |
| Bongos | 100% | Bass | 90% | Guitar | 70% | Piano | 75% |

The above is merely one example, and the music generation engine 120 may implement more instruments and tracks, creating many more variations of arrangements possible.

With the three noted parameters, the composer can easily create multiple possibilities of instrumentation for their composition. The user of music generation engine 120 then has a wide variety of choice over how their composition will sound.

A music generation engine 120 application may be considered a user-interface wrapper around the described music generation engine 120, allowing users to create musical compositions of any length and style. Although certain examples of interfaces are described, it should be understood that various interfaces may accommodate the same functionality.

Figure 6:
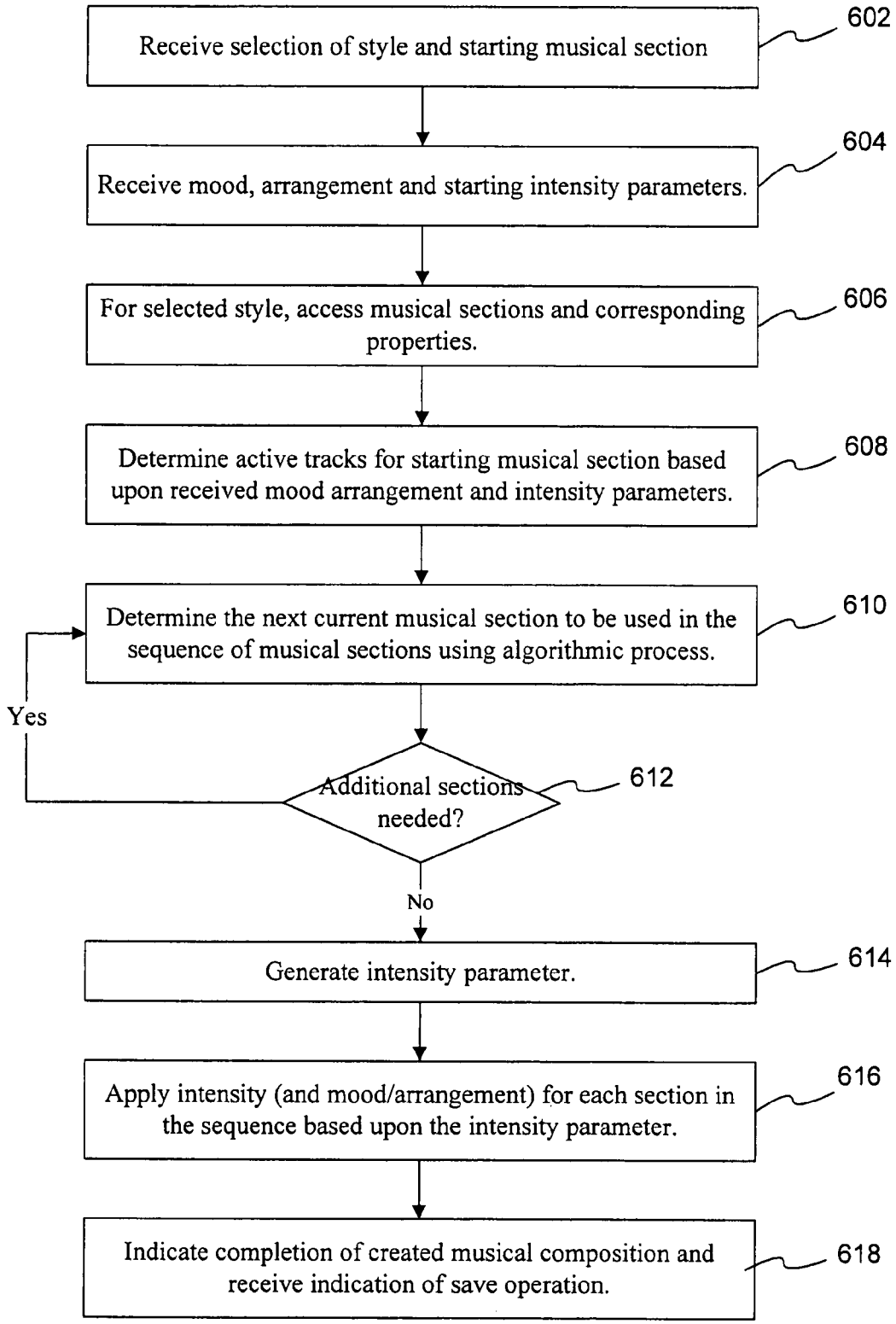
FIG. 6 is a flow chart illustrating an embodiment of a process 600 for automatically creating musical compositions

FIG. 6 is a flow chart illustrating an embodiment of a process 600 for automatically creating musical compositions.

The process 600 commences with selection 602 of a style by the user, which may be variously accommodates using conventional interfacing techniques, includes selection of available styles from a pull down menu of the like.

As mentioned, the music generation engine generates music by choosing sections, and layering different tracks over time to create unique music. As noted above, the music generation engine may create a composition by first generating the sequence information (section order) followed by the layering information. The layering is done by assigning a mood, arrangement and intensity setting to each section. One embodiment of a process for carrying out such music generation is as follows.

In addition to selecting 602 the style, to start the generation, the user provides 604 a set of input parameters to the music generation engine. In one embodiment, these input parameters include the style, the starting section, desired tempo, desired ending type (normal, fade out, loop to beginning) and their requested mood, arrangement and starting intensity. These final three parameters determine 608 the set of tracks that will be used at the start of the composition.

In conjunction with this, the music generation engine accesses 606 the musical sections that may reside in a database along with associated properties such as the similarity factor information, identification of tracks, as well as corresponding parameters and ranges for mood, intensity and arrangement.

Generation of the sequence of musical sections begins with the starting section and then the algorithmic process determines 610 the sequencing of additional sections for the musical composition being created. The process continues until it is determined 612 that no additional sections are required for the desired musical composition (which may include determination of an ending section, if desired, as described regarding the algorithmic process above).

Once the sequencing of musical sections is established, the intensity parameter is generated 614. The intensity, mood and arrangement are then applied 616 for each musical section depending upon the intensity parameter. The intensity parameter may be an intensity envelope, which is sampled at the time of each section starting time.

The intensity parameter varies along the timeline, and this parameter in turn determines which tracks are active for the corresponding section (616). During generation, music generation engine can automatically change the intensity over time to create unique variations of music. By increasing and decreasing intensity, instruments are added and removed at musical section boundaries, creating very realistic and musically pleasing results. The user can also configure the engine according to the amount and variation of intensity changes they would like within their composition.

The music generation engine may also respond to optional 'hints' from the user. These hints are markers in time that request a certain change in mood, arrangement, intensity, tempo or section. When the music generation engine encounters a hint, it attempts to adjust the generation settings to respond to these user changes in the most musically appropriate way.

As noted, the intensity parameter may be an envelope. The intensity envelope may in turn be user specified or mathematically generated. An example of a process for generating the envelope is as follows:

a. User inputs initial intensity b. User chooses either: "Hold" (meaning no intensity changes), "Linear" (intensity changes linearly from the starting intensity to the next intensity hint), or "Generate", which algorithmically generates the intensity envelope.

c. If "Generate" is chosen, the user inputs Variance and Range settings.

d. Variance determines how often the envelope will change direction. For instance, zero variance produces a completely flat intensity envelope. Medium variance produces an envelope that has a few peaks and valleys, but spaced widely in time. High variance produces an envelope with many peaks and valleys that are very close together in time.

e. Range controls the depth of the peaks and valleys. A Low range produces smaller peaks/valleys, and a high range produces larger peaks/valleys.

f. Steps b-e may be performed throughout the whole composition, or, where hints are used, or from the start (or current intensity hint) to the next intensity hint. The intensity hints allow the user to have different intensity envelopes over the course of their composition.

g. The final intensity envelope is sampled at each section's starting time, and the value of the intensity is attached to each section.

One the full composition has been generated, completion is indicated 616 to the user, who may then elect to save the created composition as a rendered file or as a library file as described previously.

Various alternatives to the described embodiments may be provided without departing from the scope of the invention. For example, in lieu of first generating the full sequence of sections and then using the intensity parameter to determine the tracks for each section, the examination of the intensity parameter and determination of tracks may occur concurrently as the sequence of sections is being built.

Thus embodiments of the present invention produce and provide for the automatic generation of musical compositions. Although the present invention has been described in considerable detail with reference to certain embodiments thereof, the invention may be variously embodied without departing from the spirit or scope of the invention. Therefore, the following claims should not be limited to the description of the embodiments contained herein in any way.

The invention claimed is:

1. A method for automatically creating musical compositions, the method comprising:

accessing a plurality of musical sections and properties corresponding to respective ones of the plurality of musical sections, the properties including predetermined similarity factors that provide a quantified indication of the similarity of individual ones of the plurality of musical sections to each and every other ones of the plurality of musical sections;

sequencing the plurality of musical sections to create a musical composition, a sequential relationship of respective ones of the plurality of musical sections being determined according to an algorithmic process that uses the predetermined similarity factors to assess the desirability of the sequential relationship; and storing the musical composition.

2. The method of claim 1, wherein the quantified indication is a percentage of similarity assigned to respective musical sections.

3. The method of claim 1, wherein the algorithmic process also applies a variance factor whose value is used to determine how similar respective musical sections should be in sequencing the plurality of musical sections.

4. The method of claim 3, wherein the algorithmic process also applies a randomness factor whose value is used to determine how random respective musical sections should be in sequencing the plurality of musical sections.

5. The method of claim 1, wherein the properties include a length of the musical section in musical units, and wherein an adjustment to a tempo value accommodates provision of the created musical composition at a prescribed duration.

6. The method of claim 1, wherein the created musical composition includes layers that respectively provide different audio elements such that the created musical composition has a first dimension along a timeline and a second dimension that provides depth of the created musical composition according to the presence of one or more of the different audio elements.

7. The method of claim 6, further comprising:

determining which different audio elements are present within respective musical sections in the created musical composition along the timeline based upon an intensity parameter.

8. The method of claim 6, wherein a given musical section is repeated, but the audio elements differ from a first instance of the given musical section as compared to a second instance of the given musical section.

9. A system for automatically creating musical compositions, the system comprising:

means for accessing a plurality of musical sections and properties corresponding to respective ones of the plurality of musical sections, the properties including predetermined similarity factors that provide a quantified indication of the similarity of individual ones of the plurality of musical sections to each and every other ones of the plurality of musical sections;

means for sequencing the plurality of musical sections to create a musical composition, a sequential relationship of respective ones of the plurality of musical sections being determined according to an algorithmic process that uses the predetermined similarity factors to assess the desirability of the sequential relationship; and means for storing the musical composition.

10. The system of claim 9, wherein the quantified indication is a percentage of similarity assigned to respective musical sections.

11. The system of claim 9, wherein the algorithmic process also applies a variance factor whose value is used to determine how similar respective musical sections should be in sequencing the plurality of musical sections.

12. The system of claim 11, wherein the algorithmic process also applies a randomness factor whose value is used to determine how random respective musical sections should be in sequencing the plurality of musical sections.

13. The system of claim 9, wherein the created musical composition includes layers that respectively provide different audio elements such that the created musical composition has a first dimension along a timeline and a second dimension that provides depth of the created musical composition according to the presence of one or more of the different audio elements.

14. The system of claim 13, further comprising:

means for determining which different audio elements are present within respective musical sections in the created musical composition along the timeline based upon an intensity parameter.

15. An apparatus for automatically creating musical compositions, the apparatus comprising:

a musical resource access module, which accesses a plurality of musical sections and properties corresponding to respective ones of the plurality of musical sections, the properties including predetermined similarity factors that provide a quantified indication of the similarity of individual ones of the plurality of musical sections to each and every other ones of the plurality of musical sections;

a sequencing module, in communication with the musical resource access module, which sequences the plurality of musical sections to create a musical composition, a sequential relationship of respective ones of the plurality of musical sections being determined according to an algorithmic process that uses the predetermined similarity factors to assess the desirability of the sequential relationship; and a musical composition storage module, which stores the musical composition.

16. The apparatus of claim 15, wherein the created musical composition includes layers that respectively provide different audio elements such that the created musical composition has a first dimension along a timeline and a second dimension that provides depth of the created musical composition according to the presence of one or more of the different audio elements.

17. The apparatus of claim 16, further comprising:

a layer management module, which determines which different audio elements are present within respective musical sections in the created musical composition along the timeline based upon an intensity parameter.

18. A computer program product comprising a computer readable medium having a musical composition stored therein, the musical composition being automatically created through software steps comprising:

accessing a plurality of musical sections and properties corresponding to respective ones of the plurality of musical sections, the properties including predetermined similarity factors that provide a quantified indication of the similarity of individual ones of the plurality of musical sections to each and every other ones of the plurality of musical sections;

sequencing the plurality of musical sections to create a musical composition, a sequential relationship of respective ones of the plurality of musical sections being determined according to an algorithmic process that uses the predetermined similarity factors to assess the desirability of the sequential relationship; and storing the musical composition on the computer readable medium.

19. A method for automatically creating musical compositions, the method comprising:

accessing a plurality of musical sections and properties corresponding to respective ones of the plurality of musical sections, the properties including an indication of the similarity of individual ones of the plurality of musical sections to one or more other ones of the plurality of musical sections;

sequencing the plurality of musical sections to create a musical composition, a sequential relationship of respective ones of the plurality of musical sections being determined according to an algorithmic process that uses the indication of similarity to assess the desirability of the sequential relationship, wherein the created musical composition includes layers that respectively provide different audio elements such that the created musical composition has a first dimension along a timeline and a second dimension that provides depth of the created musical composition according to the presence of one or more of the different audio elements; and determining which different audio elements are present within respective musical sections in the created musical composition along the timeline based upon an intensity parameter.

20. The method of claim 19, wherein the intensity parameter is an intensity envelope, which is sampled at a time corresponding to each section pursuant to determining which different audio elements are present within the respective musical sections.

21. A system for automatically creating musical compositions, the method comprising:

means for accessing a plurality of musical sections and properties corresponding to respective ones of the plurality of musical sections, the properties including an indication of the similarity of individual ones of the plurality of musical sections to one or more other ones of the plurality of musical sections;

means for sequencing the plurality of musical sections to create a musical composition, a sequential relationship of respective ones of the plurality of musical sections being determined according to an algorithmic process that uses the indication of similarity to assess the desirability of the sequential relationship, wherein the created musical composition includes layers that respectively provide different audio elements such that the created musical composition has a first dimension along a timeline and a second dimension that provides depth of the created musical composition according to the presence of one or more of the different audio elements; and means for determining which different audio elements are present within respective musical sections in the created musical composition along the timeline based upon an intensity parameter.

22. The system of claim 21, wherein the intensity parameter is an intensity envelope, which is sampled at a time corresponding to each section pursuant to determining which different audio elements are present within the respective musical sections.

* * * * *